US011728153B2

(12) United States Patent
Hendricks et al.

(10) Patent No.: US 11,728,153 B2
(45) Date of Patent: Aug. 15, 2023

(54) COLLISION CELL WITH ENHANCED ION BEAM FOCUSING AND TRANSMISSION

(71) Applicant: Thermo Finnigan LLC, San Jose, CA (US)

(72) Inventors: Paul I. Hendricks, Los Gatos, CA (US); Harald Oser, San Carlos, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 16/220,928

(22) Filed: Dec. 14, 2018

(65) Prior Publication Data

US 2020/0194244 A1 Jun. 18, 2020

(51) Int. Cl.

| | |
|---|---|
| ***H01J 49/00*** | (2006.01) |
| ***H01J 49/06*** | (2006.01) |
| ***H01J 49/42*** | (2006.01) |

(52) U.S. Cl.

CPC ..... *H01J 49/005* (2013.01); *H01J 49/063* (2013.01); *H01J 49/426* (2013.01); *H01J 49/4225* (2013.01)

(58) Field of Classification Search

CPC ..... H01J 49/005; H01J 49/426; H01J 49/063; H01J 49/4225; H01J 49/4255; H01J 49/004

See application file for complete search history.

(56) References Cited

U.S. PATENT DOCUMENTS

| | | | | |
|---|---|---|---|---|
| 5,847,386 | A | 12/1998 | Thomson et al. | |
| 6,111,250 | A * | 8/2000 | Thomson | H01J 49/005 250/281 |
| 7,145,139 | B2 | 12/2006 | Syka | |
| 7,675,031 | B2 * | 3/2010 | Konicek | H01J 49/4225 250/286 |
| 8,008,618 | B2 | 8/2011 | Londry | |
| 9,425,032 | B2 | 8/2016 | Silivra et al. | |
| 9,842,730 | B2 * | 12/2017 | Schoen | H01J 49/421 |

(Continued)

FOREIGN PATENT DOCUMENTS

| | | | |
|---|---|---|---|
| GB | 2541384 | A | 2/2017 |
| WO | WO-03102517 | A2 | 12/2003 |
| WO | WO-2019008488 | A1 | 1/2019 |

OTHER PUBLICATIONS

EP19214512.6, Extended European Search Report, dated Apr. 21, 2020, 9 pages.

(Continued)

*Primary Examiner* — Wyatt A Stoffa

(57) ABSTRACT

A multipole ion guide includes a plurality of electrodes disposed about a longitudinal axis of the device so as to define an ion transmission volume for transmitting ions along a length of the device between opposite inlet and outlet ends. An electronic controller is operably connected to an RF power source and to at least some of the electrodes and is configured to apply at least an RF potential to the electrodes. During use the electrodes generate an RF-only field along a first portion of the device and an axial DC field along a second portion of the device. Ions are focused radially inward toward the longitudinal axis of the device by the RF-only field within the first portion of the device prior to and/or subsequent to experiencing the axial DC field within the second portion of the device.

13 Claims, 10 Drawing Sheets

(56) References Cited

U.S. PATENT DOCUMENTS

| | | | | |
|---|---|---|---|---|
| 10,796,893 | B2 * | 10/2020 | Welkie | H01J 49/40 |
| 2009/0294641 | A1 | 12/2009 | Konicek et al. | |
| 2011/0127417 | A1 * | 6/2011 | Ibrahim | H01J 49/004 250/282 |
| 2011/0248157 | A1 * | 10/2011 | Sugiyama | H01J 49/063 250/282 |
| 2012/0112059 | A1 * | 5/2012 | Sugiyama | H01J 49/004 250/282 |
| 2015/0364309 | A1 * | 12/2015 | Welkie | H01J 49/063 250/288 |
| 2016/0027633 | A1 | 1/2016 | Jung et al. | |
| 2017/0125230 | A1 * | 5/2017 | Yoshinari | H01J 49/10 |
| 2017/0178885 | A1 * | 6/2017 | Welkie | H01J 49/40 |
| 2018/0114685 | A1 * | 4/2018 | Hager | H01J 49/38 |
| 2019/0019664 | A1 * | 1/2019 | Furuhashi | H01J 49/401 |
| 2019/0080895 | A1 * | 3/2019 | Jiang | G01N 27/622 |
| 2019/0157065 | A1 * | 5/2019 | Stewart | G01N 30/7233 |

OTHER PUBLICATIONS

Herfurth, F. et al., "A Linear Radiofrequency Ion Trap for Accumulation, Bunching, and Emittance Improvement of Radioactive Ion Beams", Nuclear Instruments and Methods in Physics Research A, vol. 469, 2001, pp. 254-275.

Loboda et al., "Novel Linac II electrode geometry for creating an axial field in a multipole ion guide", European Journal of Mass Spectrometry, IM Publications 2000, vol. 6 (6), pp. 531-536.

* cited by examiner

COLLISION CELL WITH ENHANCED ION BEAM FOCUSING AND TRANSMISSION

FIELD OF THE INVENTION

The present disclosure relates generally to tandem mass spectrometers of the kind having a collision cell with an elongated conductor set. More particularly, the present disclosure relates to apparatuses and methods for re-focusing an ion beam via exposure to RF-only potential during transmission through such a collision cell.

BACKGROUND

In tandem mass spectrometers such as triple quadrupole mass spectrometers, and also in other mass spectrometers, gas within the volumes defined by the RF rod sets in ion guides and collision cells improves the sensitivity and mass resolution of the instrument by a process known as collisional focusing. Collisions between the gas and the ions cause the velocities of the ions to be reduced and the ions become focused near the longitudinal axis. Although the ion focusing effect is desirable, unfortunately the slowing of the ion velocities also produces other, undesirable effects.

One such undesirable effect is that after product (daughter) ions have been formed in a collision cell downstream of a first mass filter, for example, the ions may drain slowly out of the collision cell because of their very low velocity after many collisions. The ion clear-out time (typically several tens of milliseconds) can cause tailing in the chromatogram and other spurious readings due to interference between adjacent channels when monitoring several parent/fragment pairs in rapid succession. To avoid this, a fairly substantial pause time is needed between measurements. The tailing also requires a similar pause. This required pause time between measurements reduces the productivity of the instrument.

It is known to create an axial field, sometimes referred to as a drag field, in order to move ions axially through the multipoles forming ion guides and collision cells. Several different approaches have been described for creating such axial fields.

U.S. Pat. No. 5,847,386, entitled, "Spectrometer with Axial Field," issued Dec. 8, 1998, to Thompson et al., discusses the creation of an axial field using tapered main rods, or arranging the main rods at angles with respect to each other, or segmenting the main rods. Additionally, U.S. Pat. No. 5,847,386 discusses providing resistively coated or segmented auxiliary rods, providing a set of conductive metal bands spaced along each rod with a resistive coating between the bands, forming each rod as a tube with a resistive exterior coating and a conductive inner coating, and other methods.

U.S. Pat. No. 7,675,031 to Konicek et al. discusses the creation of an axial field using auxiliary electrodes, configured with a number of finger electrodes, designed to be disposed between adjacent pairs of main electrodes. In an alternative implementation, vanes of a thin semi-conductive material such as, but not limited to, silicon dioxide are disposed between adjacent pairs of main electrodes. These so-called drag vanes can be configured to have a resistance in a direction along their lengths for creating a DC axial field when an electrical potential is applied. Straight and flat auxiliary electrodes are described for use with linear main electrodes, as well as curved auxiliary electrodes for use with curved main electrodes.

In each of the examples described above, the DC axial field extends along the entire length of the collision cell between an ion inlet end and an ion outlet end thereof. Ions experience the DC axial field immediately upon introduction into the collision cell and they continue to experience the DC axial field until they are extracted from the collision cell. During this entire time, the ions may undergo collisions with gas molecules inside the collision cell and drift away from the longitudinal axis. This effect defocuses the ions and tends to increase ion losses, which in turn leads to reduced instrumental sensitivity. In order to offset this effect, it is necessary to precisely axially align of the various sections of the instrument and provide complex lens systems between the adjacent sections. Unfortunately, these solutions increase the cost and complexity of the instrument and also necessitate rigorous set-up and maintenance procedures.

It would therefore be beneficial to provide methods and apparatuses that overcome at least some of the disadvantages and/or limitations that are mentioned above.

SUMMARY OF THE INVENTION

In accordance with an aspect of at least one embodiment there is provided a method, comprising: providing a multipole ion guide device comprising a plurality of electrodes, the electrodes being arranged one relative to another so as to define a space therebetween for transmitting ions, the multipole ion guide device having a length extending between an ion inlet end and an opposite ion outlet end thereof; introducing a population of ions into the ion inlet end of the multipole ion guide device; transmitting at least some of the ions of the population of ions along the entire length of the multipole ion guide device to the ion outlet end thereof; and during the step of transmitting, exposing the at least some of the ions to an RF-only field extending along a first portion of the length and exposing the at least some of the ions to a DC axial field extending along a second portion of the length.

In accordance with an aspect of at least one embodiment there is provided a multipole ion guide device, comprising: providing a multipole ion guide device comprising a plurality of electrodes, the electrodes being arranged one relative to another so as to define a space therebetween for transmitting ions, the multipole ion guide device having a length extending between an ion inlet end and an opposite ion outlet end thereof; applying voltages to electrodes of the plurality of electrodes and thereby forming: i) an RF-only field along a first portion of the length of the device; and ii) a DC axial field along a second portion of the length of the device; and transmitting ions through the first and second portions of the length of the multipole ion guide device, such that the ions are exposed to both the RF-only field and the DC axial field during a single pass through the device.

In accordance with an aspect of at least one embodiment there is provided a multipole ion guide device, comprising: multipole ion guide device, comprising: a plurality of electrodes disposed about a longitudinal axis of said device and being arranged one relative to another so as to define an ion transmission volume therebetween for transmitting ions along a length of said device between an ion inlet end and an opposite ion outlet end thereof; an electronic controller operably connected to an RF power source and at least some electrodes of the plurality of electrodes and being configured to apply at least an RF potential to said at least some electrodes, wherein said plurality of electrodes is configured to generate an RF-only field along a first portion of the length of said device and to generate an axial DC field along a second portion of the length of said device when said electronic controller is applying said at least an RF potential to said at least some electrodes, and wherein, during use, ions are focused radially inward toward the longitudinal axis of said device within the first portion of the length of said device.

BRIEF DESCRIPTION OF THE DRAWINGS

The instant invention will now be described by way of example only, and with reference to the attached drawings, wherein similar reference numerals denote similar elements throughout the several views, and in which.

DETAILED DESCRIPTION OF EMBODIMENTS OF THE INVENTION

Figure 1:
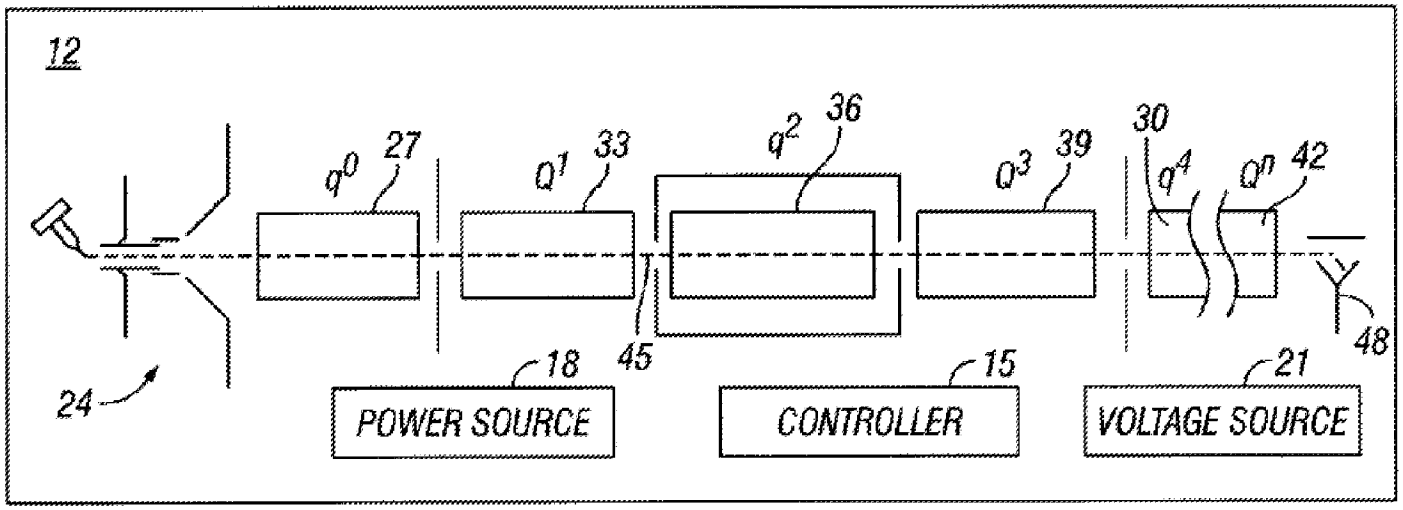
FIG. 1 shows a basic diagrammatic view of a mass spectrometer having one or more ion guides and/or collision cells in accordance with embodiments of the present invention.

The following description is presented to enable a person skilled in the art to make and use the invention and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed but is to be accorded the widest scope consistent with the principles and features disclosed herein.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Additionally, it will be understood that any list of such candidates or alternatives is merely illustrative, not limiting, unless implicitly or explicitly understood or stated otherwise. It is also to be understood, where appropriate, like reference numerals may refer to corresponding parts throughout the several views of the drawings for simplicity of understanding.

Moreover, unless otherwise indicated, numbers expressing quantities of ingredients, constituents, reaction conditions and so forth used in the specification and claims are to be understood as being modified by the term "about." Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any measured numerical values, however, inherently contain certain errors necessarily resulting from the standard deviation found in their respective testing measurements.

Turning now to the drawings, FIG. 1 shows a basic view of a mass spectrometer of the present invention, generally designated by the reference numeral 12, which often can include an ion guide or collision cell $q^0$, $q^2$, $q^4$ in accordance with the exemplary embodiments as disclosed herein. Such a mass spectrometer may also include an electronic controller 15, a power source 18 for supplying an RF voltage to the multipole devices disclosed herein, in addition to a voltage source 21 configured to supply DC voltages to predetermined devices, such as, for example, multipole and other electrode structures of the present invention.

In other example arrangements, mass spectrometer 12 often may be configured with an ion source and an inlet section 24 known and understood to those of ordinary skill in the art, of which, such sections can include, but are not limited to, electrospray ionization, chemical ionization, photo ionization, thermal ionization, and matrix assisted laser desorption ionization sections. In addition, mass spectrometer 12 may also include any number of ion guides)($q^0$) 27, ($q^4$) 30, mass filters ($Q^1$) 33, collision cells ($q^2$) 36, and/or mass analyzers ($Q^3$) 39, ($Q^n$) 42, wherein the mass analyzers 39, 42, may be of any type, including, but not limited to, quadrupole mass analyzers, two dimensional ion traps, three dimensional ion traps, electrostatic traps, and/or Fourier Transform Ion Cyclotron Resonance analyzers.

The ion guides 27, 30, collision cells 36, and analyzers 39, 42, as known to those of ordinary skill in the art, can form an ion path 45 from the inlet section 24 to at least one detector 48. Any number of vacuum stages may be implemented to enclose and maintain any of the devices along the ion path at a lower than atmospheric pressure. The electronic controller 15 is operably coupled to the various devices including the pumps, sensors, ion source, ion guides, collision cells and detectors to control the devices and conditions at the various locations throughout the mass spectrometer 12, as well as to receive and send signals representing the particles being analyzed. Specific and non-limiting examples of geometries that are appropriate for the ion guides 27, 30, collision cells 36 include quadrupole (set of four main electrodes), hexapole (set of six main electrodes) and octupole (set of eight main electrodes). The following discussion assumes a quadrupole geometry; however, it is to be understood that the same principles may be applied using either hexapole or octupole geometries.

As described above, many ion guides and collision cells suffer from the trade-off of slowing the ions down during ion transport when a gas is used to cool the ions and move them toward a central axis. Auxiliary electrodes or drag vanes have been utilized to create a DC axial field along the length of the ion guides and collision cells, which speeds up the transport of the ions but also imposes strict alignment and inter-stage focusing requirements, which in turn increases instrumental complexity and cost.

Figure 2:
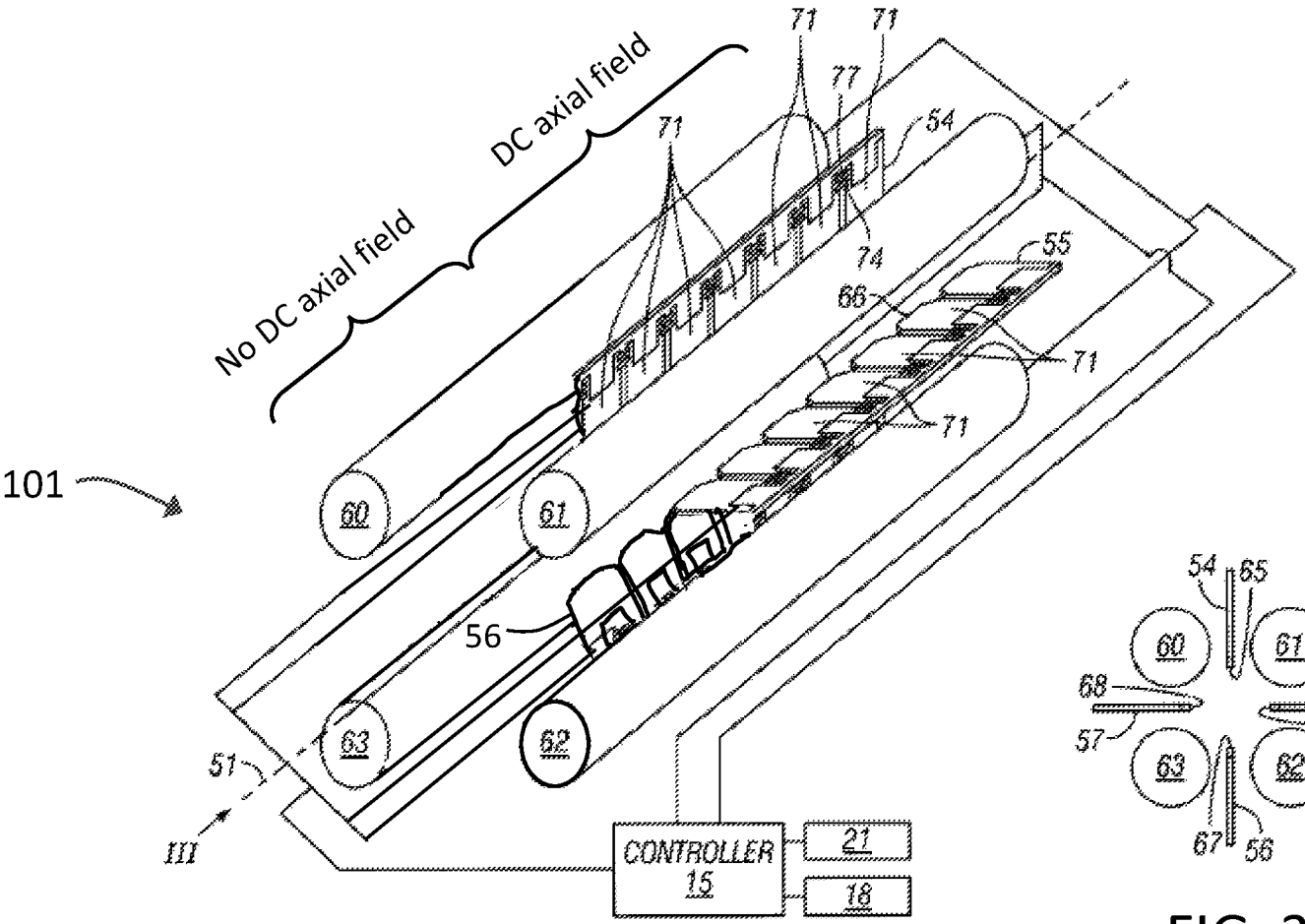
FIG. 2 is a diagrammatic perspective view of a multipole ion guide in accordance with an embodiment of the present invention.
Figure 3:
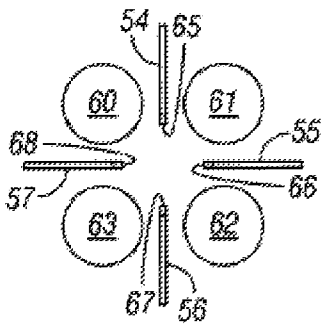
FIG. 3 shows an end view of the multipole ion guide of FIG. 2.

Referring now to FIG. 2, a diagrammatic perspective view of a multipole ion guide in accordance with an embodiment of the present invention is shown. FIG. 3 shows an end view of the multipole ion guide of FIG. 2. Auxiliary electrodes 54, 55, 56, 57, configured with one or more finger electrodes 71, are disposed between adjacent pairs of main rod electrodes 60, 61, 62, 63 of any one of the ion guides 27, 30, and/or collision cell 36 of FIG. 1. The relative positioning of the main rod electrodes and auxiliary electrodes in FIG. 2 is somewhat exploded for improved illustration, and only the auxiliary electrodes 54, 55 and 56 are visible in FIG. 2 since the auxiliary electrode 57 is completely hidden behind the main rod electrode 61. The auxiliary electrodes can occupy positions that generally define planes that intersect on a central axis 51, as shown by the directional arrow as referenced by the Roman Numeral III. These planes can be positioned between adjacent RF rod electrodes at about equal distances from the main RF electrodes of the multipole ion guide device where the quadrupolar fields are substantially zero or close to zero, for example. Thus, the configured arrays of finger electrodes 71 can lie generally in these planes of zero potential or close to zero potential so as to minimize interference with the quadrupolar fields. This arrangement is shown most clearly in FIG. 3, which also illustrates how the radial inner edges 65, 66, 67, 68 of respectively the auxiliary electrodes 54, 55, 56, 57 may be positioned relative to the main rod electrodes 60, 61, 62, 63.

Referring again to FIG. 2, as known to those of ordinary skill in the art, opposite RF voltages may be applied to each pair of oppositely disposed main RF electrodes by the electronic controller 15 so as to contain the ions radially in a desired manner. Now referring also to FIG. 4, the array of finger electrodes 71, which are configured on each of the auxiliary electrodes 54, 55, 56, 57, are often designed in the present invention to extend to and/or form part of the radially inner edges 65, 66, 67, 68 of such structures. Thus, a voltage applied to the array of finger electrodes 71 creates an axial electric field in the interior of the ion guide 27, 30 or collision cell 36 depicted in FIG. 1. As another example arrangement, each electrode of the array of finger electrodes 71 may be connected to an adjacent finger electrode 71 by a predetermined resistive element 74 (e.g., a resistor) and in some instances, a predetermined capacitor 77. The desired resistors 74 set up respective voltage dividers along lengths of the auxiliary electrodes 54, 55, 56, 57. The resultant voltages on the array of finger electrodes 71 thus form a range of voltages, often a range of step-wise monotonic voltages. The voltages create a voltage gradient in the axial direction that urges ions along the ion path 45, as shown in FIG. 1. In the example embodiment shown in FIG. 2, the voltages applied to the auxiliary rod electrodes often comprise static voltages, and the resistors often comprise static resistive elements. The capacitors 77 reduce an RF voltage coupling effect in which the RF voltages applied to the main RF rod electrodes 60, 61, 62, 63 typically couple to and heat the auxiliary electrodes 54, 55, 56, 57 during operation of the main rod electrodes 60, 61, 62, 63.

Figure 4:
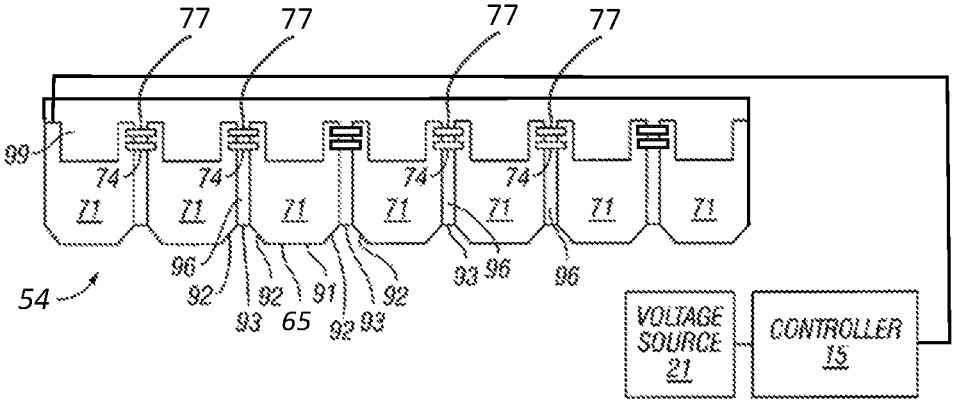
FIG. 4 is a diagrammatic top view showing an auxiliary electrode structure configured with a plurality of finger electrodes.

FIG. 4 also shows in detail the configuration of a radially inner edge 65 (which is representative of all the radially inner edges 65, 66, 67, 68) of auxiliary electrode 54 (which is representative of all the auxiliary electrodes 54, 55, 56, 57). The radially inner edge 65 includes a central portion 91 that may be metalized or otherwise provided with a conductive material, tapered portions 92 that straddle the central portion 91, and a recessed gap portion 93. The central portions 91 may be metalized in a manner that connects metallization on both the front and the back of the auxiliary electrode 54 for each of the finger electrodes 71 of the array of finger electrodes. As an innermost extent of the auxiliary electrode 54, the central portion 91 presents the DC electrical potential in close proximity to the ion path. Gaps 96 including recessed gap portions 93 are needed between metallization of the finger electrodes 71 in order to provide an electrical barrier between respective finger electrodes. However, these gaps offer a resting place for charged particles such that charged particles may reside on the surfaces in the gaps and adversely affect the gradient that is intended to be created by the voltages applied to the finger electrodes 71. Thus, the non-metalized edge surfaces of the tapered portions 92 and the recessed gap portions 93 are tapered back and away from the radially innermost extent such that the edge surfaces of the tapered portions 92 and the recessed gap portions 93 are not as accessible as dwelling places for charged particles.

A structural element for receiving and supporting metallization may be a substrate 99, as shown in FIG. 4, of any printed circuit board (PCB) material, such as, but not limited to, fiberglass, that can be formed, bent, cut, or otherwise shaped to any desired configuration so as to be integrated into the working embodiments of the present invention. Although FIGS. 2-4 show the substrates being substantially flat and having straight edges, it is to be understood that the substrates and the arrays of finger electrodes thereon may be shaped with curved edges and/or rounded surfaces, as discussed in more detail below. Substrates that are shaped and metalized in this way are relatively easy to manufacture. Thus, auxiliary electrodes in accordance with embodiments of the present invention may be configured for placement between curved main rod electrodes of curved multipoles.

In an alternative embodiment, one or more of the auxiliary electrodes can be provided by an auxiliary electrode that has dynamic voltages applied to one or more finger electrode of the array of finger electrodes 71. In this example arrangement, the controller 15, as shown in FIG. 1, may include or have added thereto computer-controlled voltage supplies (not illustrated), which may take the form of Digital-to-Analogue Converters (DACs). It is to be understood that there may be as many of these computer-controlled voltage supplies as there are finger electrodes 71 in an array, and that each computer-controlled voltage supply may be connected to and control a voltage of a respective finger electrode 71 for the array. As an alternate arrangement, each of the finger electrodes 71 at a particular axial position for all of the arrays in a multipole device may be connected to the same computer-controlled voltage supply and have the same voltage applied.

As shown in FIG. 2, the length of each one of the auxiliary electrodes 54, 55, 56, 57 is less than the length of each one of the main rod electrodes 60, 61, 62, 63. In this specific and non-limiting example, one end of each of the auxiliary electrodes 54, 55, 56, 57 is aligned with one end of each of the main rod electrodes 60, 61, 62, 63, such that that the start of the DC axial field is delayed along the direction of directional arrow III in FIG. 2. Ions that are introduced into the right-hand side of the multipole ion guide of FIG. 2 initially experience RF only potential within a region with no DC axial field. As the ions continue to move toward the left-hand side of the multipole ion guide, they subsequently encounter a DC axial field between the auxiliary electrodes 54, 55, 56, 57, which extends along the remainder of the length of the multipole ion guide. Ions undergo RF-only focusing within the no DC axial field region and are caused to move toward the longitudinal axis of the multipole ion guide prior to entering the DC axial field region. This achieves a reduction in ion loss processes upon entry into the multipole ion guide, as well as improved ion transmission into the drag region of the multipole ion guide. Advantageously, the improved ion transmission into the drag region allows for more uniform distributions of ion kinetic and internal energies resulting in richer and more consistent fragmentation spectra; potentially also improvements to the observance of low abundance fragment ions and improvements to the consistency of daughter ion abundance ratios may be observed.

Optionally, the auxiliary electrodes 54, 55, 56, 57 may be dimensioned and positioned relative to the main rod electrodes 60, 61, 62, 63 so as to form an RF-only region proximate each end of the multipole ion guide. In this case, ions introduced into the right-hand side of the multipole ion guide of FIG. 2 initially experience RF only potential within a region with no DC axial field, and then encounter a DC axial field between the auxiliary electrodes 54, 55, 56, 57 in a central region of the multipole ion guide, and then finally experience RF only potential prior to being extracted from the multipole ion guide. In this implementation, ions undergo RF-only focusing after being introduced into the multipole ion guide and also before being extracted from the multipole ion guide. This achieves not only a reduction in ion loss processes upon entry into the multipole ion guide and improved ion transmission into the drag region of the multipole ion guide, but additionally reduction in ion loss processes upon exit from the multipole ion guide and improved ion transmission into a next section of the mass spectrometer 12.

Further optionally, the lengths of the regions within which there is no DC axial field may be different at the opposite ends of the multipole ion guide. For instance, the auxiliary electrodes 54, 55, 56, 57 may be dimensioned and positioned relative to the main rod electrodes 60, 61, 62, 63 so as to provide a longer region within which there is no DC axial field at the ion outlet end of the multipole ion guide, such that the ions are well focused prior to being extracted.

By way of a specific example, the auxiliary electrodes 54, 55, 56, 57 may be shortened, relative to each end of the main rod electrodes 60, 61, 62, 63, by between 2.5 $r_o$ and 5 $r_o$, where $r_o$ is the inscribed radius of the RF electrodes main rod electrodes 60, 61, 62, 63. As discussed above, the auxiliary electrodes 54, 55, 56, 57 may be shortened by this amount at one end or at both ends of the multipole ion guide, in either a symmetric or asymmetric fashion. However, when implemented in a collision cell the resulting length of the DC axial field must still be long enough to allow for sufficient ion fragmentation.

Figures 5, 6:
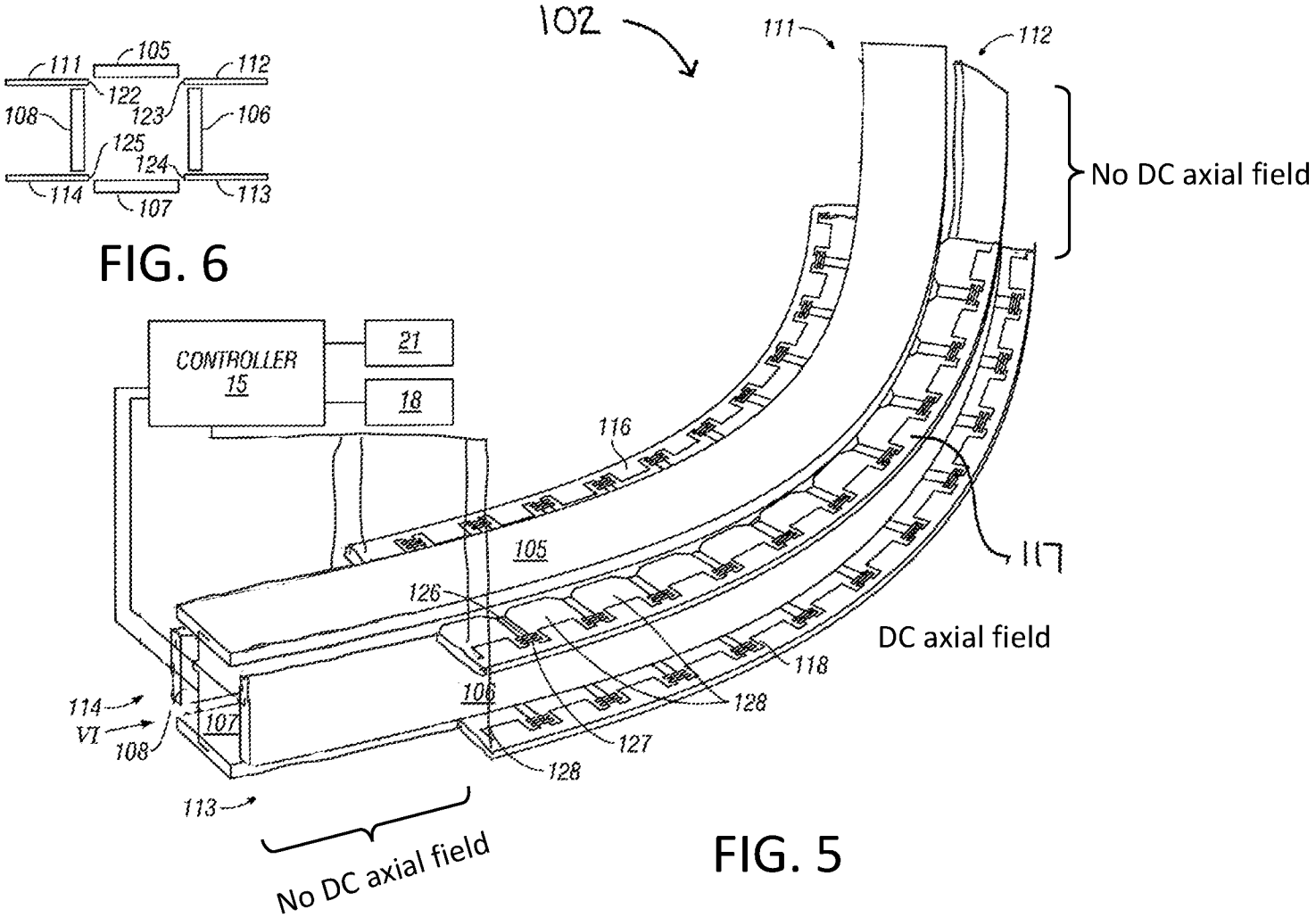
FIG. 5 is a diagrammatic perspective view of another multipole ion guide in accordance with an embodiment of the present invention.
FIG. 6 shows an end view of the multipole ion guide of FIG. 4.

Referring now to FIG. 5, shown is a diagrammatic perspective view of another multipole ion guide 102 in accordance with an embodiment of the present invention. FIG. 6 shows an end view of the multipole ion guide of FIG. 5. As will be apparent, the multipole ion guide 102 is curved and may be an ion guide or a collision cell incorporated into the mass spectrometer 12 shown in FIG. 1. The multipole ion guide 102 includes main RF electrodes 105, 106, 107, 108 that are connected to a controller 15 for application of RF voltages from a power source 18, as described with reference to the embodiment shown in FIG. 2 as discussed above. The main RF electrodes may be formed of rectangular cross-sectional material (as illustrated) for reduced cost and ease of manufacture.

Auxiliary electrodes 111, 112, 113, 114 are inserted between the main electrodes 105, 106, 107, 108 and DC voltages are applied to the auxiliary electrodes 111, 112, 113, 114, as has been described with regard the embodiments of FIGS. 2-4. In particular, the substrates 116, 117, 118 of auxiliary electrodes 111, 112, 113, respectively, as well as the not illustrated substrate of auxiliary electrode 114, are shaped to match the curvature of the main RF electrodes 105, 106, 107, 108.

In the end view perspective of FIG. 6 taken in a direction of arrow VI of FIG. 5, first and second auxiliary electrodes 111 and 112 are oriented to substantially form a continuous surface if extended to meet together inside the main RF electrodes 105, 106, 107, 108. Similarly, third and fourth auxiliary electrodes 113, 114 are aligned with each other. These generally co-planar orientations of pairs of the auxiliary electrodes 111, 112, and 113, 114 provide greater ease of manufacturing. Nevertheless, the radially innermost edges 122, 123, 124, 125 are presented between adjacent ones of the main RF electrodes 105, 106, 107, 108, as shown in FIG. 6, and as described with regard to the embodiments of FIGS. 2-4 above.

As may be appreciated from FIG. 5, metallization on an underside of a particular substrate, e.g., substrate 117, may be a mirror image of the metallization on an upper surface of another predetermined substrate, e.g., substrate 118. Similar to the embodiments described above, resistors 122 and capacitors 126 may interconnect adjacent finger electrodes 128 to provide a voltage divider along a length of the multipole device 102. Alternatively, a DAC may be connected to each respective finger electrode 128 in an array.

As with the other example embodiments, the array of finger electrodes 128 is disposed on opposite sides of the circuit board material that forms each of the substrates. Similar to the other example embodiments described above, the array of finger electrodes 128 may include a printed or otherwise applied conductive material on an edge of the printed circuit board material that joins the conductive material on opposite sides of the circuit board material. In this way, the array of finger electrodes presents the conductive material on a majority of a radially innermost edge surface of the auxiliary electrode. Also similar to the other embodiments, there are recesses 92 in the edges of the circuit board material between respective finger electrodes 128 of the finger electrode array. Thus, available sites for ion deposit on an insulative material surface of the circuit board material are recessed radially outward away from the ion beam or path.

As with the other embodiments, the printed circuit board material utilized in forming the auxiliary electrodes for the embodiment of FIGS. 5 and 6 may provide a structural foundation or substrate for the conductive material of metallization of the finger electrodes 128. The auxiliary electrodes, e.g., 111, 112, may include curved thin plates forming curved substrates for positioning between two curved adjacent main electrodes of a multipole device 102. The array of finger electrodes 128 may be disposed on the curved thin plates. In this and the other embodiments, the substrates may take the form of thin plates. The array of finger electrodes may be disposed on the thin plates. The electrical elements, including any resistors and capacitors, may be provided with low profiles or may be integral with the thin plates such that the substrate with the electrical elements forms a monolithic unit for positioning between the at least two adjacent main electrodes of multipole devices.

Alternatively, a DAC may be connected to a group of finger electrodes 128, which are in turn connected to each other by resistors 126 as shown and described with regard to the embodiment of FIG. 4. That is, DACs and/or resistors may be connected to the auxiliary electrodes to apply and control DC electric voltages to the auxiliary electrodes in any combination without departing from the scope of the invention.

The embodiments that have been discussed with reference to FIGS. 2-6 utilize auxiliary electrodes that are positioned between main RF electrodes in order to create a DC axial field within a predetermined region of the multipole ion guide, but not within other regions of the multipole ion guide. Of course, any other electrode configuration that is capable of producing the same results may be utilized instead. Some additional examples of suitable electrode configurations are illustrated in FIGS. 7-22. More particularly, FIGS. 7-17 show electrode configurations that include auxiliary electrodes in addition to the main RF electrodes and FIGS. 18-22 show electrode configurations that do not include auxiliary electrodes in addition to the main RF electrodes.

Figure 7:
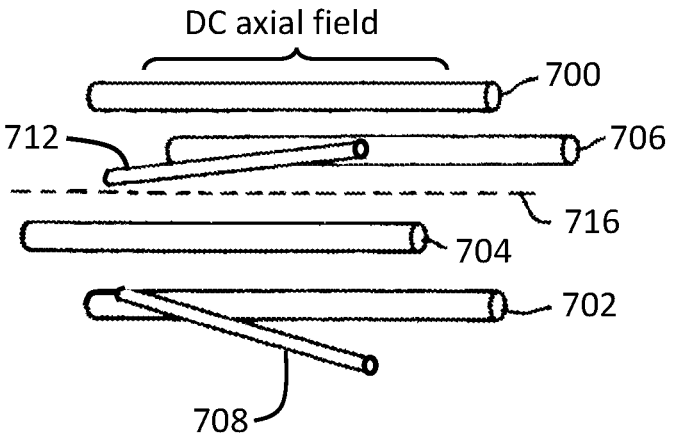
FIG. 7 is a diagrammatic perspective view of another multipole ion guide in accordance with an embodiment of the present invention.
Figure 8:
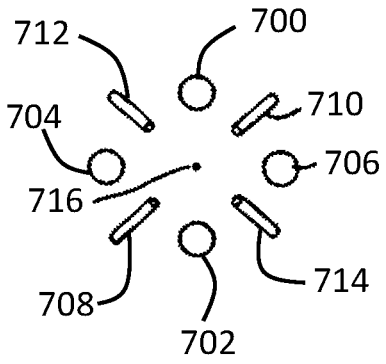
FIG. 8 is an end view looking at the left side end of the multipole ion guide of FIG. 7.
Figure 9:
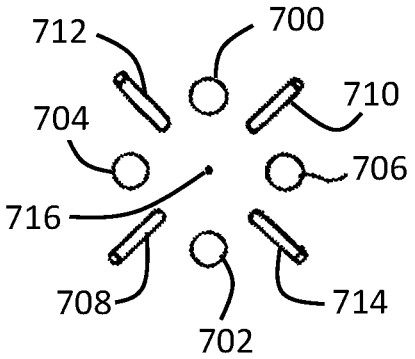
FIG. 9 is an end view looking at the right side end of the multipole ion guide of FIG. 7.

FIG. 7 shows a perspective view of a quadrupole arrangement of four main RF electrodes 700, 702, 704, 706 with pairs of non-parallel auxiliary electrodes 708, 710 and 712, 714 arranged to create an axial DC field within a predetermined central portion of the length of the multipole ion guide. FIGS. 8 and 9 show end views looking at the left and right side ends of the multipole device of FIG. 7, respectively. As will be apparent, the auxiliary electrodes 708, 710 and 712, 714 are rod-shaped electrodes that are disposed one-each between adjacent pairs of main RF electrodes 700, 702, 704, 706. The auxiliary electrodes 708, 710, 712, 714 are non-parallel one relative to another and also non-parallel relative to the main RF electrodes 700, 702, 704, 706. As is shown most clearly in FIGS. 8 and 9, the auxiliary electrodes 708, 710, 712, 714 diverge along the length of the multipole ion guide and thereby produce a DC axial field along the longitudinal axis 716. In this example the auxiliary electrodes 708, 710, 712, 714 are shorter than the main RF electrodes 700, 702, 704, 706 and are disposed such that the DC axial field is formed only within a central portion of the multipole ion guide. As a result, the opposite end regions have an RF-only potential that focuses ions toward central axis 716. Alternatively, the auxiliary electrodes 708, 710, 712, 714 are dimensioned and positioned relative to the main RF electrodes 700, 702, 704, 706 such that the DC axial field extends to one of the ends of the multipole ion guide. In this case, an RF-only potential that focuses ions toward central axis 716 is formed at only one of the ends of the multipole ion guide.

Figure 10:
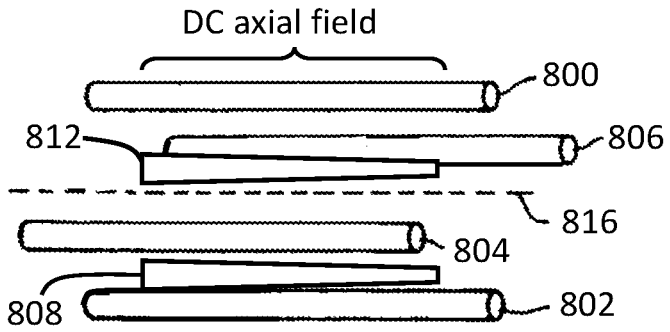
FIG. 10 is a diagrammatic perspective view of another multipole ion guide in accordance with an embodiment of the present invention.
Figure 11:
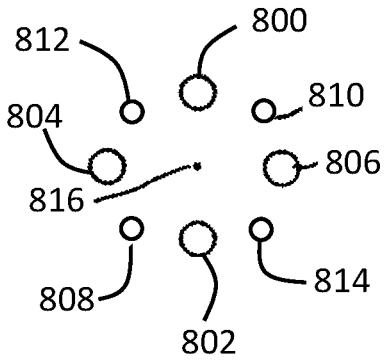
FIG. 11 is an end view looking at the left side end of the multipole ion guide of FIG. 10.
Figure 12:
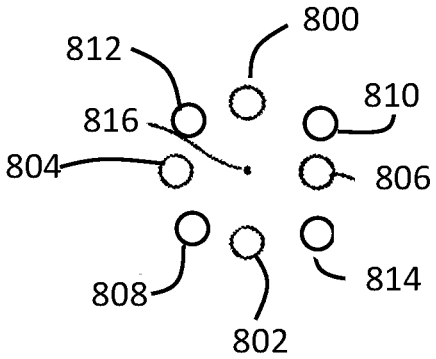
FIG. 12 is an end view looking at the right side end of the multipole ion guide of FIG. 10.

FIG. 10 shows a quadrupole arrangement of four main RF electrodes 800, 802, 804, 806 with pairs of tapered auxiliary electrodes 808, 810 and 812, 814 arranged to create an axial DC field within a predetermined central portion of the length of the multipole ion guide. FIGS. 11 and 12 show end views looking at the left and right side ends of the multipole device of FIG. 10, respectively. As will be apparent, the auxiliary electrodes 808, 810, 812, 814 are tapered such that the diameter thereof decreases in a common direction and thereby produce a DC axial field along the longitudinal axis 816. In this example the auxiliary electrodes 808, 810, 812, 814 are shorter than the main RF electrodes 800, 802, 804, 806 and are disposed such that the DC axial field is formed only within a central portion of the multipole ion guide. As a result, the opposite end regions have an RF-only potential that focuses ions toward central axis 816. Alternatively, the auxiliary electrodes 808, 810, 812, 814 are dimensioned and positioned relative to the main RF electrodes 800, 802, 804, 806 such that the DC axial field extends to one of the ends of the multipole ion guide. In this case, an RF-only potential that focuses ions toward central axis 816 is formed at only one of the ends of the multipole ion guide.

Figure 13:
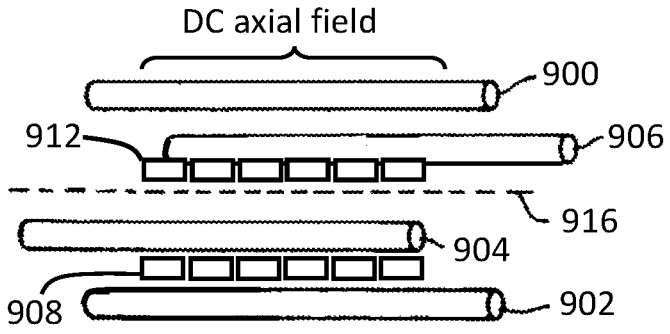
FIG. 13 is a side view of another multipole ion guide in accordance with an embodiment of the present invention.
Figure 14:
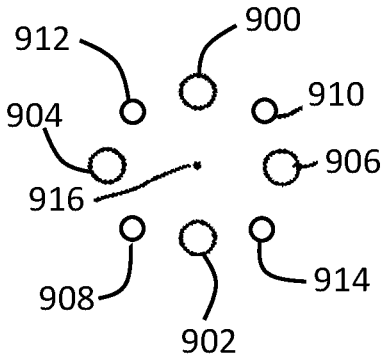
FIG. 14 is an end view of the multipole ion guide of FIG. 13.

FIG. 13 shows a quadrupole arrangement of four main RF electrodes 900, 902, 904, 906 with pairs of segmented auxiliary electrodes 908, 910 and 912, 914 arranged to create an axial DC field within a predetermined central portion of the length of the multipole ion guide. FIG. 14 shows an end view of the multipole device of FIG. 13. Appropriate potentials may be applied to the segments of the segmented auxiliary electrodes 908, 910, 912, 914 to produce a DC axial field along the longitudinal axis 916. In this example the segmented auxiliary electrodes 908, 910, 912, 914 are shorter than the main RF electrodes 900, 902, 904, 906 and are disposed such that the DC axial field is formed only within a central portion of the multipole ion guide. As a result, the opposite end regions have an RF-only potential that focuses ions toward central axis 916. Alternatively, the auxiliary electrodes 908, 910, 912, 914 are dimensioned and positioned relative to the main RF electrodes 900, 902, 904, 906 such that the DC axial field extends to one of the ends of the multipole ion guide. In this case, an RF-only potential that focuses ions toward central axis 916 is formed at only one of the ends of the multipole ion guide.

Figure 15:
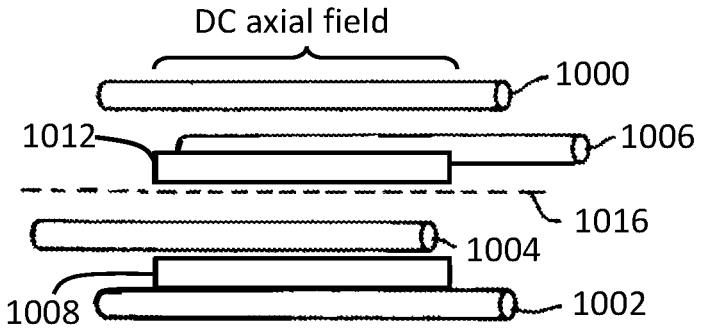
FIG. 15 is a side view of another multipole ion guide in accordance with an embodiment of the present invention.
Figure 16:
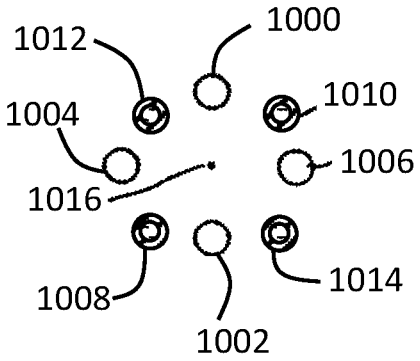
FIG. 16 is an end view of the multipole ion guide of FIG. 15.

FIG. 15 shows a quadrupole arrangement of four main rod electrodes 1000, 1002, 1004, 1006 with pairs of auxiliary electrodes 1008, 1010, 1012, 1014, each having an insulating core with a surface layer of resistive material, arranged to create an axial DC field within a predetermined central portion of the length of the multipole ion guide. A voltage applied between the two ends of each auxiliary electrode causes a current to flow in the resistive layer, establishing a potential gradient from one end to the other. With all four auxiliary rods connected in parallel, i.e. with the same voltage difference $V_1$ between the ends of the auxiliary rods, the fields generated contribute to the electric field on the central axis 1016 of the quadrupole ion guide, establishing a DC axial field. If the resistive layer is of constant resistivity, then the field will be constant. A non-uniform layer may be applied to generate a non-linear field if desired.

Alternatively, embodiments may be envisaged that do not utilize auxiliary electrodes positioned between the main rod electrodes to create a DC axial field within a predetermined region of the multipole ion guide but not within other regions of the multipole ion guide. In these embodiments, the main rod electrodes are suitably configured to produce a RF-only potential at one or both ends and a DC axial field within a predetermined region.

Figure 17:
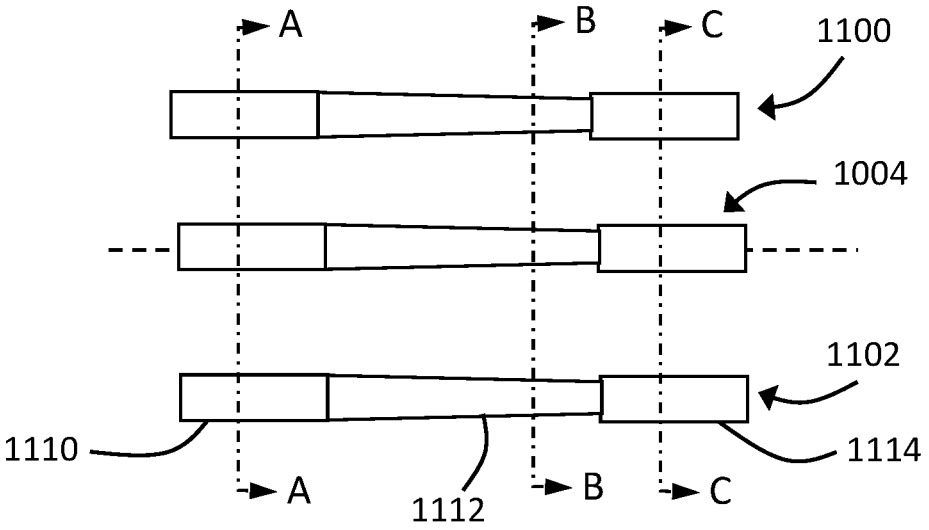
FIG. 17 is a side view of another multipole ion guide in accordance with an embodiment of the present invention.
Figure 18:
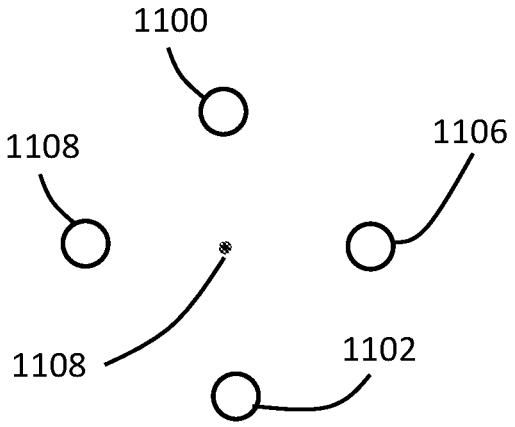
FIG. 18 is a cross-sectional view taken in a plane A-A or C-C in FIG. 17.
Figure 19:
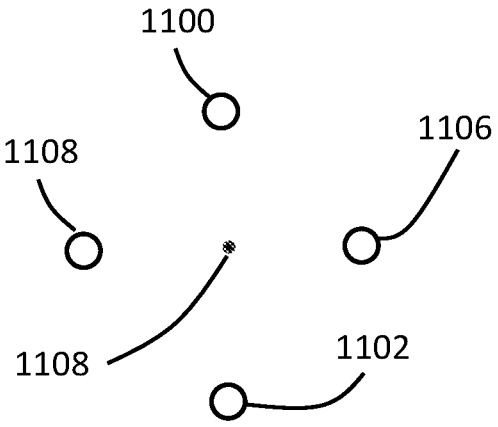
FIG. 19 is a cross-sectional view taken in a plane B-B in FIG. 17.

FIG. 17 is a side view of a quadrupole arrangement of four main rod electrodes 1100, 1102, 1104, 1106 (electrode 1106 is hidden in FIG. 17). FIG. 18 is a cross-sectional view taken in a plane A-A or C-C normal to the longitudinal axis 1108. FIG. 19 is a cross-sectional view taken in a plane B-B normal to the longitudinal axis 1108. In this embodiment each of the four main rod electrodes includes a first section 1110 of constant diameter, a second section 1112 of tapered diameter, and a third section 1114 of constant diameter equal to the diameter of the first section. The first section 1110 of the four main rod electrodes 1100, 1102, 1104, 1106 cooperate to form a RF-only potential that focuses ions toward the longitudinal axis 1108. The second section 1112 of the four main rod electrodes 1100, 1102, 1104, 1106 cooperate to form a DC axial field. The third section 1114 of the four main rod electrodes 1100, 1102, 1104, 1106 cooperate to form a RF-only potential that focuses ions toward the longitudinal axis 1108. Optionally, the rods 1100, 1102, 1104, 1106 each have only a single section of constant diameter and the tapered second section extends to one end of the multipole ion guide.

Figure 20:
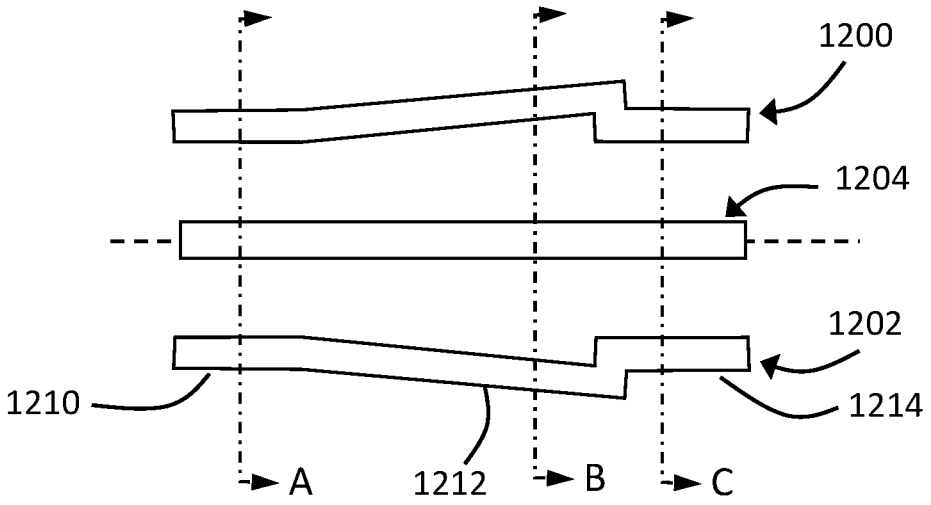
FIG. 20 is a side view of another multipole ion guide in accordance with an embodiment of the present invention.
Figure 21:
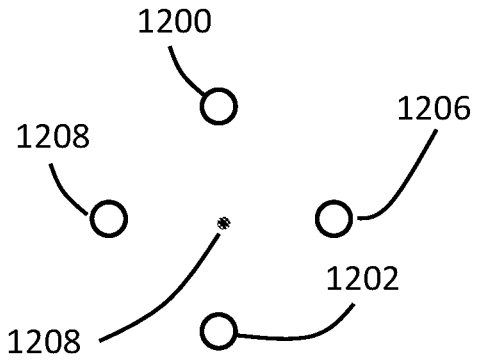
FIG. 21 is a cross-sectional view taken in a plane A-A or C-C in FIG. 20.
Figure 22:
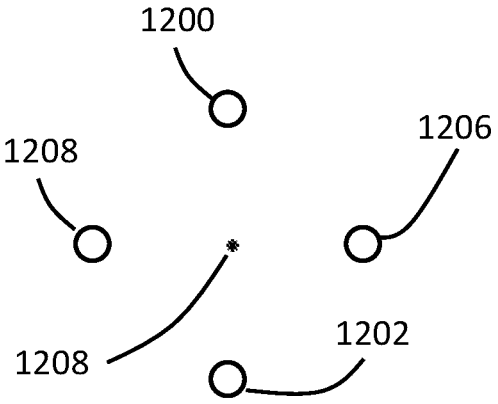
FIG. 22 is a cross-sectional view taken in a plane B-B in FIG. 20.

FIG. 20 is a side view of a quadrupole arrangement of four main rod electrodes 1200, 1202, 1204, 1206 (electrode 1206 is hidden in FIG. 20). FIG. 21 is a cross-sectional view taken in a plane A-A or C-C normal to the longitudinal axis 1208. FIG. 22 is a cross-sectional view taken in a plane B-B normal to the longitudinal axis 1208. In this embodiment each of the four main rod electrodes includes a first section 1210, a second section 1212, and a third section 1214. The first sections 1210 of the four main rod electrodes 1200, 1202, 1204, 1206 are parallel one relative to another and form a RF-only potential that focuses ions toward the longitudinal axis 1208. As shown in FIG. 21, the spacing between the four main rod electrodes is identical within the first and third sections. Optionally, the spacing between the four main rod electrodes is different within the first section than it is within the third section. The second sections 1212 of the four main rod electrodes 1200, 1202, 1204, 1206 are non-parallel one relative to another, and so the electrode bodies effectively diverge in a left-to-right direction in FIG. 20, and thereby form a DC axial field. The third sections 1214 of the four main rod electrodes 1200, 1202, 1204, 1206 are also parallel one relative to another and form a RF-only potential that focuses ions toward the longitudinal axis 1108. Optionally, the rods 1200, 1202, 1204, 1206 each have only a single section within which the rods are parallel one relative to another and the diverging second section extends to one end of the multipole ion guide.

The different electrode configurations described above result in several advantages including more forgiving mechanical geometry and less sensitive to axial alignment of q2, Q1 and Q3 in terms of instrument sensitivity. For instance, the sensitivity is enhanced due to reduction of ion the loss processes that occur after ions are introduced into the multipole ion guide as well as when the ions are extracted from the multipole ion guide. Further, the design ion optic systems between stages of the mass spectrometer may be simplified and DC ion focusing elements can be reduced and or eliminated because transmission between the stages is facilitated by RF only lensing. By way of an example, two of the three DC lenses that are typically provided between the different stages could be eliminated. Alternatively, the instrument could be run at a higher pressure.

As already discussed above, the RF-only focusing of the ions that are introduced into a collision cell leads to improved transmission into the drag region of the collisions cell and allows for more uniform distributions of ion kinetic and internal energies, resulting in richer and more consistent fragmentation spectra. Further, improvements to the observance of low abundance fragment ions and improvements to the consistency of daughter ion abundance ratios may be observed.

Specific and non-limiting examples have been illustrated and described herein in order to clearly explain the subject-matter that is considered to be inventive. Additional modifications may be made to the various examples without departing from the scope of the invention. For instance, specific examples have been shown in which the main RF electrodes are generally circular or square/rectangular in a cross-sectional view taken in a plane normal to the electrode length. However, any other suitably shaped electrode may be used instead, such as for instance RF electrodes that are true hyperbolic shape in cross-section.

Additional advantages may include more consistent instrument to instrument performance and simpler and faster instrument tuning.

As used herein, including in the claims, unless the context indicates otherwise, singular forms of the terms herein are to be construed as including the plural form and vice versa. For instance, unless the context indicates otherwise, a singular reference, such as "a" or "an" means "one or more".

Throughout the description and claims of this specification, the words "comprise", "including", "having" and "contain" and variations of the words, for example "comprising" and "comprises" etc., mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example", "e.g." and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

What is claimed is:

1. A method comprising:

providing a multipole comprising a plurality of electrodes, the plurality of electrodes including rod electrodes and auxiliary electrodes, the rod electrodes being arranged one relative to another so as to define a space therebetween for transmitting ions, the multipole having a length extending between an ion inlet end and an opposite ion outlet end thereof;

applying voltages to electrodes of the plurality of electrodes and thereby forming:

i) an RF-only field along a first portion of the length of the multipole; and ii) a DC axial field along a second portion of the length of the multipole; and transmitting ions through the first and second portions of the length of the multipole, such that the ions are exposed to both the RF-only field and the DC axial field during a single pass through the multipole, wherein the ions transmit through the first portion prior to transmitting through the second portion, wherein auxiliary electrodes disposed between the rod electrodes of the multipole are not parallel with the rod electrodes of the multipole; and wherein a first end of the auxiliary electrodes is shortened relative to a first end of the rod electrodes by between 2.5 $r_0$ and 5 $r_0$ wherein $r_0$ is an inscribed radius of the rod electrodes.

2. The method of claim 1, wherein the ions are introduced into the ion inlet end of the multipole, and wherein the ions pass through the first portion of the length of the multipole and then subsequently pass through the second portion of the length of the multipole.

3. The method of claim 2, comprising applying voltages to electrodes of the plurality of electrodes and thereby forming an RF-only field along a third portion of the length of the multipole, wherein the second portion of the length is disposed between the first and third portions of the length.

4. The method of claim 1, wherein the multipole is disposed within a housing of a collision cell in a mass spectrometer instrument, and wherein the ions are introduced into the ion inlet end of the multipole from a mass-resolving section of the mass spectrometer instrument.

5. The method of claim 1, wherein a second end of the auxiliary electrodes is aligned with a second end of the rod electrodes.

6. A multipole, comprising:

a plurality of electrodes including rod electrodes disposed about a longitudinal axis and being arranged one relative to another so as to define an ion transmission volume therebetween for transmitting ions along a length of said multipole between an ion inlet end and an opposite ion outlet end thereof;

the plurality of electrodes further including auxiliary electrodes disposed between the rod electrodes of the multipole, the auxiliary electrodes not oriented parallel to the rod electrodes, a first end of the auxiliary electrodes being shortened relative to a first end of the rod electrodes by between 2.5 $r_0$ and 5 $r_0$ wherein $r_0$ is an inscribed radius of the rod electrodes;

an electronic controller operably connected to an RF power source and the plurality of electrodes and being configured to apply at least an RF potential to said at least some electrodes, wherein said plurality of electrodes is configured to generate an RF-only field along a first portion of the length of said multipole and to generate an axial DC field along a second portion of the length of said multipole when said electronic controller is applying said at least an RF potential to said at least some electrodes, and wherein, during use, ions are focused radially inward toward the longitudinal axis of said multipole within the first portion of the length of said multipole, and transmit through the first portion before the second portion.

7. The multipole of claim 6, wherein said rod electrodes comprises at least six elongate electrodes.

8. The multipole of claim 6, wherein said rod electrodes comprises eight elongate electrodes.

9. The multipole of claim 6, wherein said auxiliary electrodes comprises at least one pair of rod-shaped electrodes disposed on opposite sides of the longitudinal axis and being arranged non-parallel one with respect to the other.

10. The multipole of claim 6, wherein the rod electrodes include a portion that extends longitudinally beyond one end of the auxiliary electrodes, said portion defining the first portion of the length of the multipole.

11. The multipole of claim 6, wherein the first portion of the length of the multipole is disposed between an ion inlet orifice and the second portion of the length of the multipole.

12. The multipole of claim 6, wherein the first portion of the length of the multipole is disposed between an ion outlet orifice and the second portion of the length of the multipole.

13. The multipole of claim 6, wherein a second end of the auxiliary electrodes is aligned with a second end of the rod electrodes.

* * * * *